United States Patent [19]

Varis et al.

[11] 4,184,506

[45] Jan. 22, 1980

[54] VACUUM SEWER SYSTEM

[76] Inventors: Martti Varis, Kirvuntie 53, 02140 Espoo 14; Krister Nordberg, 64230 Närpiö as., both of Finland

[21] Appl. No.: 668,262

[22] Filed: Mar. 18, 1976

Related U.S. Application Data

[63] Continuation of Ser. No. 535,853, Dec. 23, 1974, abandoned.

[30] Foreign Application Priority Data

Dec. 29, 1973 [FI] Finland ..... 4043/73

[51] Int. Cl.[2] ..... C02C 1/00

[52] U.S. Cl. ..... 137/205; 417/120; 417/144

[58] Field of Search ..... 137/205, 209; 417/120, 417/144

[56] References Cited

U.S. PATENT DOCUMENTS 2,434,027 1/1948 Whittington ..... 417/144 X 3,730,884 5/1973 Burns ..... 137/205 UX

*Primary Examiner*—Alan Cohan

*Attorney, Agent, or Firm*—Haseltine, Lake & Waters

[57] ABSTRACT

A vacuum sewer system, comprising a number of sewage feeding devices connected to a sewer pipe system under partial vacuum. The arrangement further comprises a self-discharging sewage collecting container to which the suction duct of a vacuum pump has been connected. This vacuum pump suction duct is provided with a valve by means of which the connection between the collecting container and the vacuum pump can be shut off. The outlet end of the sewer pipe system is connected to the collecting container through a non-return valve and there is also a device by means of which the collecting container can be put under atmospheric pressure or under a higher pressure. The different operations are governed by an automatic control device which effects emptying of the collecting container at suitable intervals.

10 Claims, 2 Drawing Figures

Figure 1:
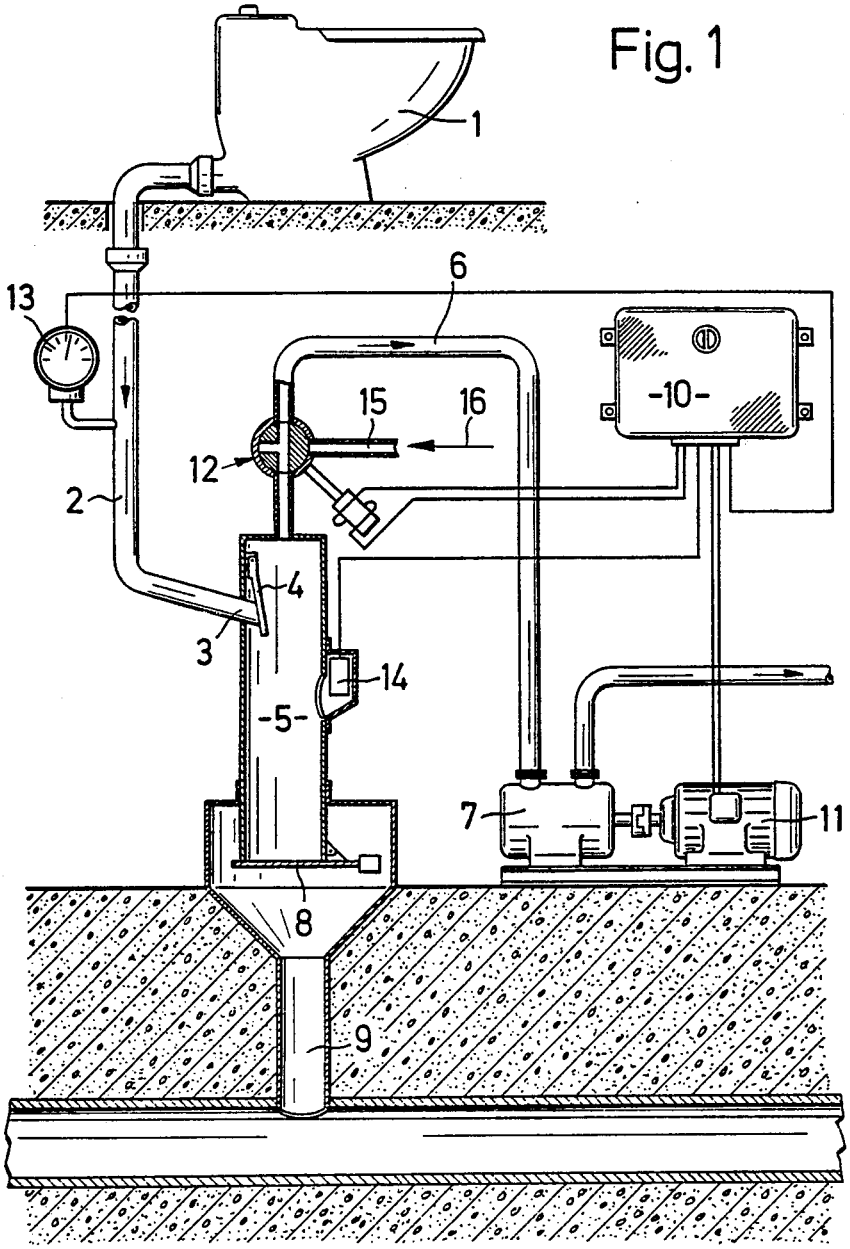

1
6
13
15
16
-10-
12
2
4
3
14
-5-
7
11
8
9

VACUUM SEWER SYSTEM

The present application is a continuation of the parent application Ser. No. 535,853 filed Dec. 23, 1974, now abandoned.

The invention relates to a vacuum sewer system, comprising a sewer pipe under partial vacuum, a vacuum pump, at least one sewage feeding device connected to the sewer pipe, a discharge means including a self-discharging collecting chamber with the suction duct of a vacuum pump connected thereto, and an automatic control device.

In known vacuum sewer systems, the emptying of the sewer system constitutes a considerable problem. A collecting container under partial vacuum is used in some systems, which is a disadvantageous solution, because containers of this kind are very expensive. Different discharge devices have also been invented, by means of which sewage can be discharged from the vacuum system into a collecting tank under atmospheric pressure. Known discharge devices of this kind are, however, relatively complicated and expensive.

The object of the invention is to provide a vacuum sewer system, where the emptying of the vacuum sewer is arranged in a less complicated way than previously. The invention is characterized in that said suction duct of the vacuum pump connected to the self-discharging collecting chamber is provided with a valve by means of which the connection between the collecting chamber and the vacuum pump can be shut off and that to the collecting chamber is also connected the end portion of a sewer pipe through a non-return valve and a device by means of which the collecting chamber can be put under atmospheric pressure or a higher pressure. The expression "self-discharging" means in the context that the chamber in question, at least under certain conditions, automatically empties itself.

In a discharge device according to the invention, there is only one chamber, which makes it possible to simplify the structure of the discharge device considerably. The use of only one single collecting chamber is made possible by connecting the vacuum pump to the vacuum sewer through the collecting chamber and a non-return valve. When the collecting chamber is emptied, the connection between the collecting chamber and the vacuum pump is shut off and the collecting chamber is simultaneously put under atmospheric pressure or under a higher pressure. Different valves can be used for this, but it is also possible to use only one three-way valve. The aim is that the connection between the collecting chamber and the atmosphere, or a source of higher pressure, is opened automatically when the connection between the collecting chamber and the vacuum pump is shut off. By using a three-way valve such a function is obtained in a simple way.

In the collecting chamber, there should preferably be a level sensor or a corresponding device connected to an automatic control system in such a way that the connection between the collecting chamber and the vacuum pump is shut off and the collecting chamber put under at least atmospheric pressure when the level of the sewage in the collecting chamber has reached a certain predetermined value. Thus the collecting of too much sewage in the collecting chamber, before it is emptied, is avoided. The control device is advantageously provided with a delay arrangement, arranged to delay the reopening of the connection between the collecting chamber and the vacuum pump after it has been shut off, so that there is with certainty time for the collecting chamber to be emptied before a new amount of sewage can flow into the collecting chamber.

Since it is essential for the function of the system that in the sewer pipe there is always a sufficiently low pressure, the sewer pipe is preferably provided with a pressure transducer connected to the control device so that the vacuum pump starts working if the pressure in the sewer pipe rises too high.

In order to increase the capacity of the vacuum system or to improve its service reliability, two or more parallel discharge units can be used which can be arranged to work either simultaneously or alternately, for instance, so that when the connection between the suction duct and the first collecting chamber is shut off, the connection between the suction duct and the second collecting chamber is opened.

Figure 2:
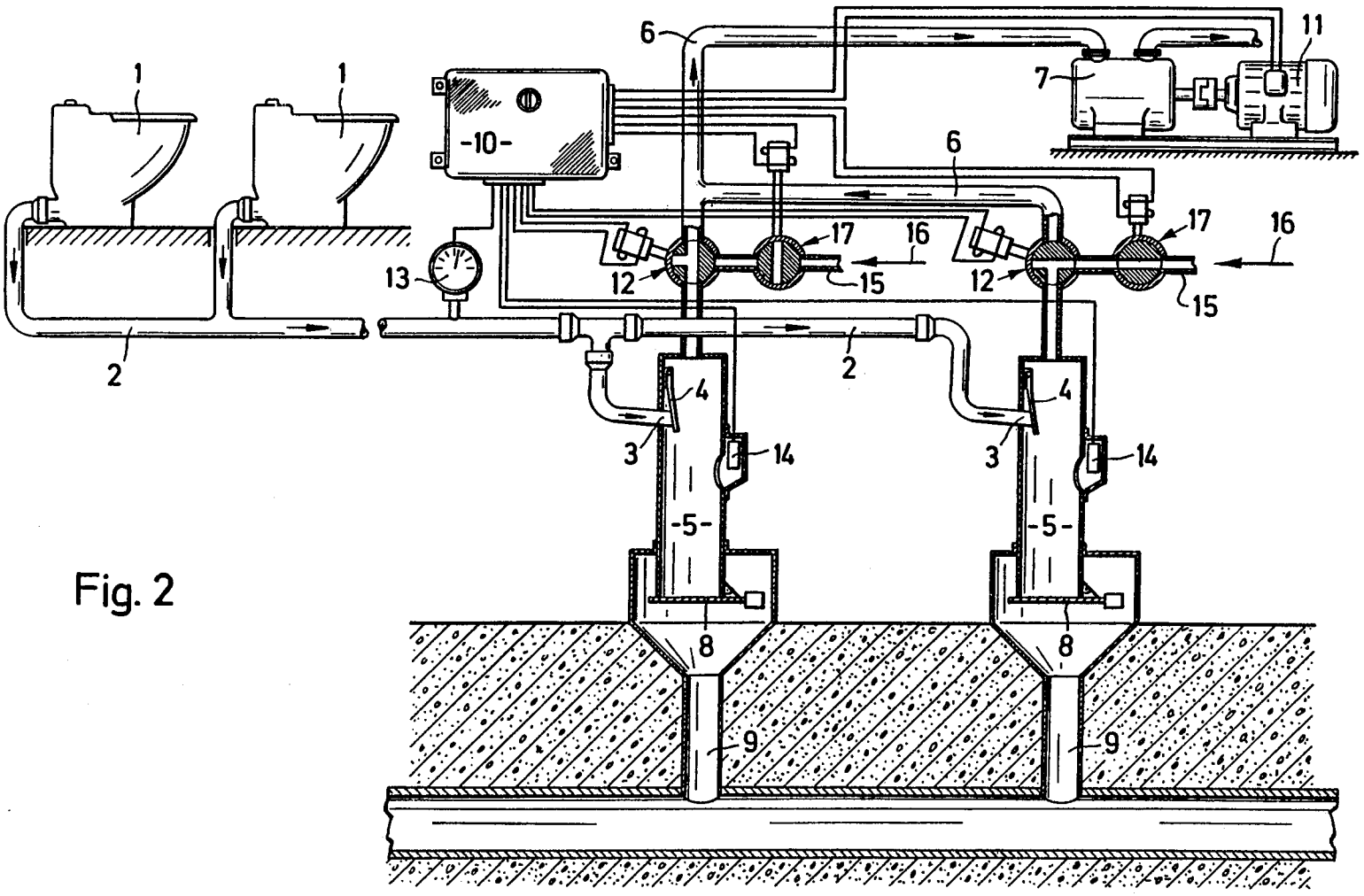

In the following, the invention is described more in detail with reference to the attached drawing, in which FIG. 1 shows a schematical scheme of a sewer system according to the invention and FIG. 2 shows a schematical scheme of another embodiment of the invention.

In the drawing, 1 indicates a water closet or the like, connected to a vacuum-sewer 2. There may be several devices of this kind. The end portion 3 of the sewer pipe 2 is through a non-return valve 4 connected to a collecting chamber 5. The collecting chamber is through a suction pipe 6 connected to a vacuum pump 7 and through a bottom flap 8 of non-return type connected to, for instance, a gravity sewer 9 or to some other space, where the discharged sewage is collected. The system also comprises an automatic control device 10 which, when required, starts and stops the motor 11 of the vacuum pump 7 and opens or closes, by means of a three-way valve 12, the connection between the collecting chamber 5 and the vacuum pump or the atmosphere. The vacuum pump 7 has to be started only if the pressure in the vacuum sewer 2 rises too high. To the sewer pipe 2 is connected a pressure sensor 13 which by means of the control device 10 starts the motor 11 of the pump if the pressure in the sewer pipe reaches a certain predetermined value. When the vacuum pump 7 starts, the valve 12 takes the position shown in FIG. 1 and vacuum is created in the collecting chamber 5, whereby also the pressure in the sewer pipe 2 through the non-return valve 4 decreases to the same value as in the collecting chamber. Simultaneously may sewage flow from the sewer pipe 2 into the collecting chamber 5. When a sufficiently low pressure has been obtained in the pipe 2, the pressure transducer 13 stops the motor 11 of the vacuum pump 7 by means of the control device 10.

When the vacuum pump 7 stops, a connection to the atmosphere opens through valve 12 and the collecting tank 5 is put under atmospheric pressure. under these circumstances the collecting chamber is self-discharging because the weight of sewage therein is sufficient to open the bottom flap 8. In order to ensure the emptying of the collecting tank 5 it is possible to use over-pressure instead of atmospheric pressure. A suitable pressure air source, in the drawing symbolized by an arrow 16, is then connected to the open inlet tube 15 of valve 12.

When the vacuum pump 7 works and the connection to the collecting chamber 5 through valve 12 is open, the collecting tank 5 is under partial vacuum and cannot empty itself. If in such a case too much sewage is collected in the collecting chamber 5, the sewage influences a level sensor 14 which by means of the control device 10 closes the connection to the vacuum pump. If the pressure in the sewer pipe 2 still is too high, the connection between the collecting chamber and the vacuum pump opens immediately upon the sewage level having sunk below the activity range of the level sensor. In order to avoid this, the control device 10 is provided with a delay arrangement, which delays the reopening of the connection to the vacuum pump for such a time that there is with certainty time enough for the collecting chamber 5 to be emptied. The delay arrangement can be of the conventional capacitor-based type.

FIG. 2 shows the use in parallel of a plurality of emptying units according to the invention. The arrangement is basically the same as the one already described. The only difference is that if a pressure air source 16 is connected to the inlet tube 15 of valve 12, then it is advisable to provide the tube 15 with an automatically operated shut-off valve 17 in order to avoid unnecessary losses of pressure air. The two emptying units shown are used alternatively so that one is under vacuum and connected to the vacuum sewer 2, while the other is emptied. After the emptying operation the unit in question may be left under atmospheric pressure but it is also possible to connect it to the vacuum sewer system at once.

The invention is not limited to the embodiments shown, but several variations of the invention are feasible within the scope of the attached claims.

We claim:

1. A vacuum sewer system comprising a plurality of sewage producing units, a sewer pipe system with sewage conveying pipe being under normal working conditions constantly under partial vacuum and being connected to said units and arranged to convey sewage from said units to a discharge unit, each discharge unit having only a single sewage collecting chamber with a bottom having a gravity operated discharge means of check valve type, each outlet end of a sewage conveying pipe of said sewer pipe system being connected through a check valve directly to the upper portion of said single collecting chamber of one of said discharge units, a pump connected to said collecting chamber for producing a partial vacuum in said collecting chamber, and means for releasing at intervals the vacuum produced by said pump in said collecting chamber for allowing discharge of the sewage collected therein.

2. A vacuum sewer system comprising plurality of sewage producing units, a sewer pipe system with sewage conveying pipe under partial vacuum connected to said units and arranged to convey sewage from said units to a discharge station, said discharge station comprising at least one discharge unit, each discharge unit having a single collecting chamber with a bottom provided with a gravity operated discharge means of check valve type, each outlet end of a sewage conveying pipe of said sewer pipe system being connected through a check valve directly to the upper portion of said single collecting chamber of said discharge unit, a pump connected to said collecting chamber for producing a partial vacuum in said collecting chamber, a valve for closing the connection between said pump and collecting chamber, and means for placing said collecting chamber under at least atmospheric pressure.

3. A system according to claim 1, including connection means between said collecting chamber and said pump and having means for closing at intervals the connection between said pump and collecting chamber and opening a connection between said collecting chamber and the atmosphere.

4. A system according to claim 1, wherein said collecting chamber has means for raising the pressure therein above atmospheric pressure.

5. A system according to claim 1, wherein the connection between said collecting chamber and a pressure source of at least atmospheric pressure is arranged to open automatically upon closure of the connection between said collecting chamber and said vacuum pump.

6. A system according to claim 1, wherein the connection between said collecting chamber and a pressure source of at least atmospheric pressure is arranged to open automatically upon stopping said vacuum pump.

7. A system according to claim 3, wherein said collecting chamber has a level sensor connected to said connection means for closing the connection between said collecting chamber and said vacuum pump when the level of sewage in said collecting chamber reaches a predetermined position.

8. A system according to claim 7, wherein said connection means includes delay means delaying the reopening of said connection for a predetermined time so as to allow said collecting chamber to be emptied before said connection is reopened, when the connection between said collecting chamber and said vacuum pump has been closed by said level sensor.

9. A system according to claim 3, wherein said connection means is connected to a pressure transducer sensing the pressure in said vacuum sewer pipe system, said transducer starting said vacuum pump upon the pressure in said vacuum sewer pipe system reaching a predetermined maximum value.

10. A vacuum sewer system as defined in claim 1 including connection means between said collecting chamber and said pump and having means for closing at intervals the connection between said pump and collecting chamber and opening a connection between said collecting chamber and the atmosphere, means in said collecting chamber for raising the pressure therein above atmospheric pressure, the connection between said collecting chamber and said means for raising the pressure being arranged to open automatically upon closure of the connection between said collecting chamber and said vacuum pump, said collecting chamber having a level sensor connected to said connection means for closing the connection between said collecting chamber and said vacuum pump when the level of sewage in said collecting chamber reaches a predetermined position, said connection means including delayed means delaying the reopening of said connection for predetermined times so as to allow said collecting chamber to be emptied before said connection is reopened, when the connection between said collecting chamber and said vacuum pump has been closed by said level sensor, said connection means being connected to a pressure transducer sensing the pressure in said vacuum sewer pipe system, said transducer starting said vacuum pump upon the pressure in said vacuum sewer pipe system reaching a predetermined maximum value.

* * * * *